US011498229B2

(12) United States Patent
Chen

(10) Patent No.: US 11,498,229 B2
(45) Date of Patent: Nov. 15, 2022

(54) EASILY DISASSEMBLED FOLDING KNIFE

(71) Applicant: GB II Corporation, Tualatin, OR (US)

(72) Inventor: Chu-Ming Chen, Taichung (TW)

( * ) Notice: Subject to any disclaimer, the term of this patent is extended or adjusted under 35 U.S.C. 154(b) by 45 days.

(21) Appl. No.: 17/217,795

(22) Filed: Mar. 30, 2021

(65) Prior Publication Data

US 2021/0299892 A1 Sep. 30, 2021

Related U.S. Application Data

(60) Provisional application No. 63/003,142, filed on Mar. 31, 2020.

(51) Int. Cl.
*B26B 1/04* (2006.01)
*B26B 1/10* (2006.01)

(52) U.S. Cl.
CPC . *B26B 1/04* (2013.01); *B26B 1/10* (2013.01)

(58) Field of Classification Search
CPC .. B26B 1/02; B26B 1/048; B26B 1/10; B26B 1/04
See application file for complete search history.

(56) References Cited

U.S. PATENT DOCUMENTS 298,115 A 5/1884 Peace
1,049,931 A 1/1913 Smith
1,182,043 A 5/1916 Schless
1,299,173 A 4/1919 Grey
1,350,251 A 8/1920 Armour
1,353,490 A 9/1920 Pantlalek
1,428,296 A 9/1922 Neft
1,487,655 A 3/1924 Hlavecek
1,667,462 A 4/1928 Logan
2,263,415 A * 11/1941 Schaaff ..... B26B 1/042 30/160
3,007,244 A 11/1961 Vern
3,061,927 A 11/1962 Von Frankenburg und Ludwigsdorf
3,488,843 A 1/1970 Tims, Jr.
3,829,967 A 8/1974 Gilbert
4,161,818 A 7/1979 Phelps
4,218,819 A 8/1980 Phelps
(Continued)

FOREIGN PATENT DOCUMENTS

CN 2194827 Y 4/1995
CN 2275020 Y 2/1998
(Continued)

*Primary Examiner* — Jennifer S Matthews
(74) *Attorney, Agent, or Firm* — Klarquist Sparkman, LLP

(57) ABSTRACT

A folding knife includes a handle, a blade, a pivot element, and a locking mechanism. The handle includes a first side portion and a second side portion disposed on either side of the blade. The pivot element extends from the first side portion and through the opening of the blade such that the blade can pivot about the cylindrical portion from a storage position to a use position. The locking member is movable between a locked position and an unlocked position. In the locked position, relative rotational movement between the first and second side portions of the handle is restricted. In the unlocked position, the first and second side portions of the handle can rotate relative to each other, and the first and second side portions of the handle can be separated when a non-circular opening of the handle aligns with a non-circular portion of the pivot element.

20 Claims, 14 Drawing Sheets

(56) References Cited

U.S. PATENT DOCUMENTS

| | | | | |
|---|---|---|---|---|
| 4,233,737 | A | 11/1980 | Poehlmann | |
| 4,408,394 | A | 10/1983 | Phelps | |
| 4,730,393 | A | 3/1988 | Coburn | |
| 5,022,156 | A | 6/1991 | Kallens et al. | |
| 5,572,793 | A | 11/1996 | Collins et al. | |
| 5,594,966 | A | 1/1997 | Goldman | |
| 5,605,495 | A | 2/1997 | Jenkins, Jr. | |
| 5,661,908 | A | 9/1997 | Chen | |
| 5,916,277 | A | 6/1999 | Dallas | |
| 6,101,723 | A | 8/2000 | Ford | |
| 6,134,788 | A | 10/2000 | Chen et al. | |
| 6,591,504 | B2 | 7/2003 | Onion | |
| 6,751,820 | B1 | 6/2004 | Wu | |
| 6,802,126 | B2 | 10/2004 | Huang | |
| 6,865,816 | B1 | 3/2005 | Zajdel | |
| 6,942,255 | B2 | 9/2005 | Pickering | |
| 7,022,915 | B1 | 4/2006 | Galguera | |
| 7,100,285 | B1 | 9/2006 | Huang | |
| 7,134,207 | B2 | 11/2006 | Ping | |
| 7,162,803 | B2 | 1/2007 | Lu | |
| 7,246,441 | B1 | 7/2007 | Collins | |
| 7,370,421 | B2 | 5/2008 | Onion et al. | |
| 7,716,839 | B2 | 5/2010 | Onion et al. | |
| 8,051,518 | B2 | 11/2011 | Massaro | |
| 8,087,173 | B2 | 1/2012 | Tang et al. | |
| 8,499,460 | B1 | 8/2013 | Pearman | |
| 8,893,389 | B2 | 11/2014 | Freeman | |
| 9,061,426 | B2 | 6/2015 | Harvey | |
| 9,492,916 | B2 | 11/2016 | Snyder | |
| 9,586,328 | B2 | 3/2017 | Onion | |
| 9,592,612 | B2 | 3/2017 | Koenig | |
| 9,597,809 | B2 | 3/2017 | Onion | |
| 9,943,970 | B2 | 4/2018 | Glesser | |
| 10,226,871 | B2 | 3/2019 | Huang | |
| 10,272,576 | B2 * | 4/2019 | Onion | B26B 1/044 |
| 10,654,180 | B2 | 5/2020 | Onion et al. | |
| 10,759,067 | B2 | 9/2020 | Huang | |
| 11,279,050 | B2 * | 3/2022 | Onion | B26B 5/00 |
| 2004/0139613 | A1 | 7/2004 | Onion | |
| 2005/0257377 | A1 | 11/2005 | Lu et al. | |
| 2006/0272157 | A1 | 12/2006 | Zeng | |
| 2007/0011884 | A1 | 1/2007 | Hua et al. | |
| 2008/0172884 | A1 | 7/2008 | Cheng | |
| 2008/0222896 | A1 | 9/2008 | Marfione et al. | |
| 2010/0177508 | A1 | 7/2010 | Maglica | |
| 2010/0281696 | A1 | 11/2010 | Hao et al. | |
| 2011/0041344 | A1 | 2/2011 | De et al. | |
| 2011/0272265 | A1 | 11/2011 | Mortun | |
| 2012/0011728 | A1 | 1/2012 | Keers | |
| 2012/0017443 | A1 | 1/2012 | Hao | |
| 2012/0124754 | A1 | 5/2012 | Frazer | |
| 2012/0272534 | A1 | 11/2012 | Lee | |
| 2013/0174351 | A1 | 7/2013 | Carson | |
| 2014/0027234 | A1 | 1/2014 | Zhou et al. | |
| 2014/0245615 | A1 | 9/2014 | Onion et al. | |
| 2016/0029733 | A1 | 2/2016 | Kovarik et al. | |
| 2016/0031096 | A1 | 2/2016 | Koenig | |
| 2016/0059429 | A1 | 3/2016 | Mayes | |
| 2016/0271809 | A1 | 9/2016 | Bloch | |
| 2016/0311123 | A1 | 10/2016 | Schoon | |
| 2017/0334077 | A1 | 11/2017 | Onion et al. | |
| 2018/0117777 | A1 * | 5/2018 | Onion | B26B 5/00 |
| 2018/0169874 | A1 | 6/2018 | Halucha | |
| 2018/0290282 | A1 | 10/2018 | Wang | |
| 2019/0118395 | A1 | 4/2019 | Cheng | |
| 2019/0202073 | A1 | 7/2019 | Huang | |
| 2019/0217488 | A1 * | 7/2019 | Lo | B26B 1/044 |
| 2019/0232508 | A1 | 8/2019 | Onion | |
| 2019/0321991 | A1 | 10/2019 | Medhurst | |
| 2020/0101633 | A1 | 4/2020 | Halucha | |
| 2020/0338766 | A1 | 10/2020 | Huang | |
| 2021/0107172 | A1 | 4/2021 | Onion | |
| 2021/0299892 | A1 | 9/2021 | Chen | |

FOREIGN PATENT DOCUMENTS

| | | | | | |
|---|---|---|---|---|---|
| CN | 2326401 | Y | | 6/1999 | |
| CN | 2385854 | Y | | 7/2000 | |
| CN | 2456890 | Y | | 10/2001 | |
| CN | 1303762 | A | | 4/2004 | |
| CN | 2774721 | Y | | 4/2006 | |
| CN | 2902614 | Y | | 5/2007 | |
| CN | 201401419 | Y | | 2/2010 | |
| CN | 201471444 | U | | 5/2010 | |
| CN | 201500984 | U | | 6/2010 | |
| CN | 201544254 | U | | 8/2010 | |
| CN | 104029223 | A | | 9/2014 | |
| CN | 104260025 | A | | 1/2015 | |
| CN | 112265018 | A | * | 1/2021 | B26B 1/02 |
| DE | 202008005736 | U1 | * | 8/2008 | B25G 1/06 |
| GB | 108823 | A | | 8/1917 | |
| WO | WO 1999/000224 | A2 | | 1/1999 | |

* cited by examiner

EASILY DISASSEMBLED FOLDING KNIFE

CROSS-REFERENCE TO RELATED APPLICATION

This application claims the benefit of U.S. Provisional Patent Application No. 63/003,142, filed Mar. 31, 2020, which is incorporated by reference herein.

FIELD

The present disclosure relates to folding knives and, more particularly, to folding knives configured to be easily disassembled.

BACKGROUND

Folding knives are available in various configurations. In some of these configurations, the blade of a folding knife can be removable to facilitate cleaning, sharpening, replacement, or storing of a blade. As examples, U.S. Pat. Nos. 7,370,421 and 7,716,839 describe a knife having a removable blade. Because folding knives having removable blades are particularly advantageous in harsh conditions (i.e., in situations where a knife is likely to become dirty or dull, and thus where the ability to clean, sharpen, or replace a blade in the field is important), it would be beneficial to provide a folding knife with a removable blade having as simple a structure as possible. Simpler configurations can help to ensure that the blade remains easily removable after use in harsh conditions and that removal of the blade can be accomplished as quickly and reliably as possible. Accordingly, simple mechanisms allowing a folding knife to be easily disassembled are desirable.

SUMMARY

The present disclosure is direct to folding knives that can be more easily disassembled than known folding knives, such as for cleaning or replacing a blade or other components. For example, folding knives disclosed herein can be manually disassembled, that is, disassembled without the use of additional tools (e.g., without a screwdriver, etc.). In some cases, easily disassembled folding knives include a handle having first and second side portions having complementary locking elements which can prevent the side portions from being separated from one another.

In one representative embodiment, a folding knife includes a handle, a blade, a pivot element, and a locking mechanism. The handle includes a first side portion and a second side portion. The second side portion of the handle includes a non-circular opening formed in a first end portion and a groove formed in a second end portion. The blade includes an opening and is disposed between the first side portion and the second side portion. The pivot element includes a cylindrical portion and a non-circular portion and is fixedly coupled to the first side portion of the handle. The cylindrical portion extends through the opening of the blade such that the blade can pivot about the cylindrical portion from a storage position to a use position. The non-circular portion is configured to mate with the non-circular opening of the second side portion. The locking mechanism includes a connecting member and a securing member. The connecting member is fixedly coupled to the first side portion and includes a head portion configured to extend into the groove of the second side portion. The securing member is coupled to the connecting member and is movable between a locked position and an unlocked position. In the locked position, the securing member engages the connecting member, retains the head portion of the connecting member within the groove of the second side portion, and retains the first side portion and the second side portion in a rotationally aligned configuration. In the unlocked position, the securing member disengages the connecting member, allows the first side portion and the second side portion to rotate relative to each other from the rotationally aligned configuration to a rotationally offset configuration, and allows the head portion of the connecting member to withdraw from the groove of the second side portion. When the first side portion and the second side portion are in the rotationally aligned configuration, the non-circular opening of the second side portion is rotationally offset from the non-circular portion of the pivot element, thereby preventing the first side portion from separating from the second side portion. When the first side portion and the second side portion are in the rotationally offset configuration, the non-circular opening of the second side portion is rotationally aligned from the non-circular portion of the pivot element, thereby allowing the first side portion to be separated from the second side portion.

In some embodiments, the groove includes an insertion region and a track region. The insertion region comprises a width that is greater than or equal to a width of the head portion of the connecting member, and the track region comprises a width that is less than a width of the head portion of the connecting member.

In some embodiments, the head portion of the connecting member is disposed in the track region of the groove when the first side portion and the second side portion are in the rotationally aligned configuration, and the head portion of the connecting member is disposed in the insertion region of the groove when the first side portion and the second side portion are in the rotationally offset configuration.

In some embodiments, the securing member includes a guide portion with a slot. The connecting member extends through the slot. The securing member is slidable relative to the connecting member from a first end of the slot to a second end of the slot. The first end of the slot corresponds to the locked position, and the second end of the slot corresponds to the unlocked position.

In some embodiments, a rear portion of the second side portion comprises a window through which the securing member extends when the securing member is in the locked position.

In some embodiments, the groove in the second side portion of the handle comprises an arcuate shape.

The various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosure will become more apparent from the following detailed description, which proceeds with reference to the accompanying figures.

BRIEF DESCRIPTION OF THE DRAWINGS

FIG. 3 also depicts a locking mechanism of the knife in a locked position.

DETAILED DESCRIPTION

General Considerations

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially (e.g., assembly or disassembly of a folding knife) may in some cases be rearranged or performed concurrently. Moreover, for the sake of simplicity, the attached figures may not show the various ways in which the disclosed methods can be used in conjunction with other methods. As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked. Two components that are coupled to the each other can be directly connected to each other or can be indirectly connected to each other with one or more intermediate elements between the coupled items.

Exemplary Embodiments

The present disclosure concerns folding knives that can be more easily disassembled and assembled than typical folding knives, such as for cleaning or replacing a blade or other component. For example, the folding knives disclosed herein can be manually disassembled/assembled, that is, disassembled/assembled without the use of additional tools (e.g., without a screwdriver, etc.). The disclosed folding knives include a handle having first and second side portions having complementary locking elements which can selectively prevent the side portions from being separated from one another.

Figure 1:
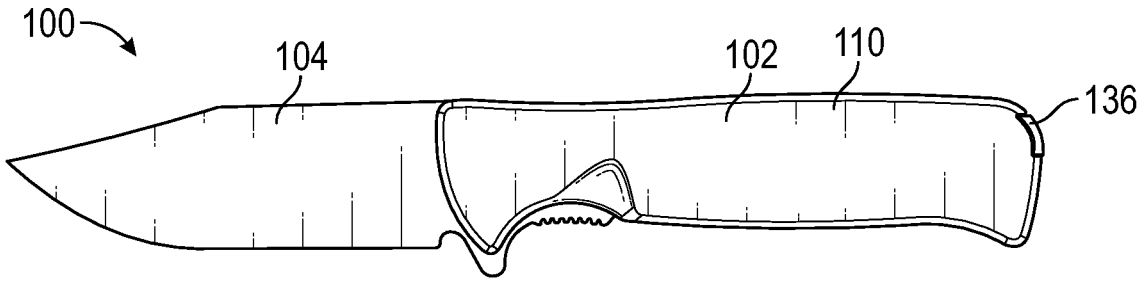
FIG. 1 depicts a side view of an exemplary folding knife, depicting a first side of the knife and a blade of the knife in a use position.
Figure 2:
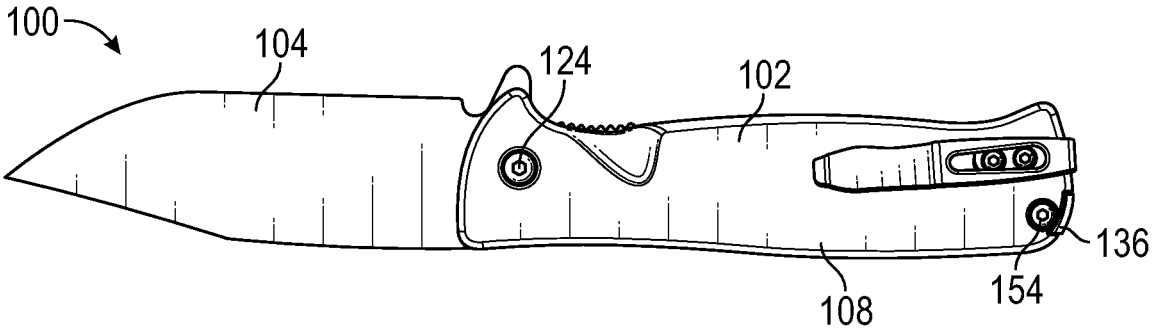
FIG. 2 depicts a side view of the knife, depicting a second side of the knife and the blade of the knife in the use position.
Figure 3:
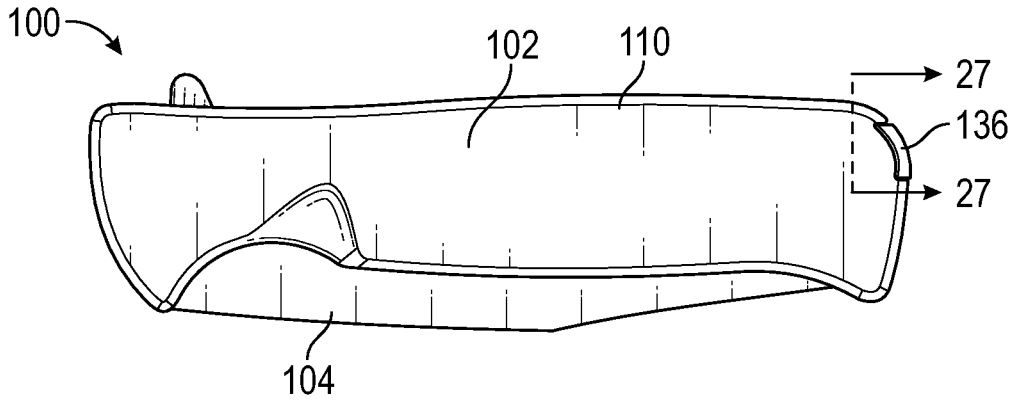
FIG. 3 depicts a side view of the knife, depicting the first side of the knife and the blade of the knife in a storage position.
Figure 4:
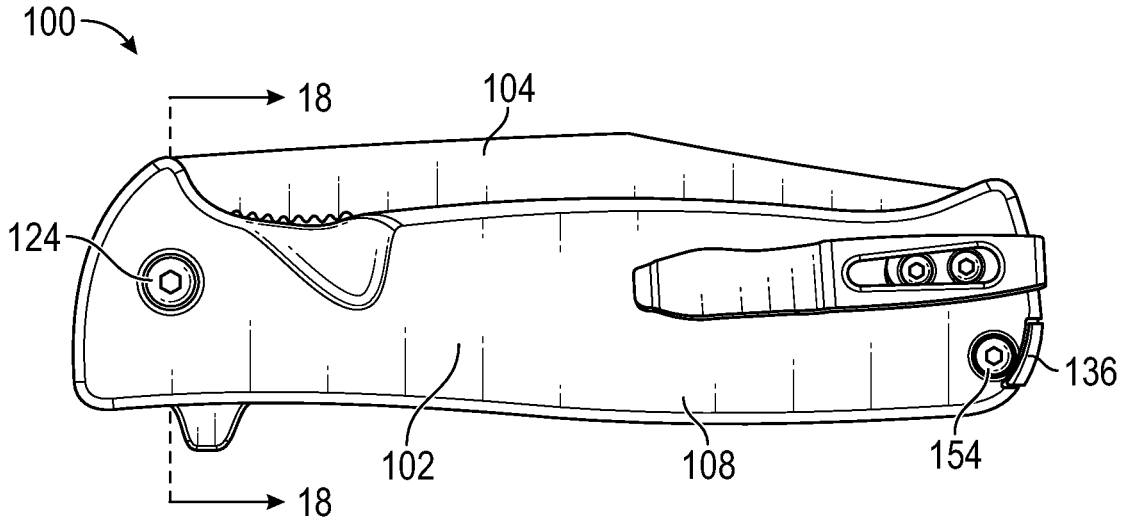
FIG. 4 depicts a side view of the knife, depicting the second side of the knife and the blade of the knife in the storage position.
Figure 5:
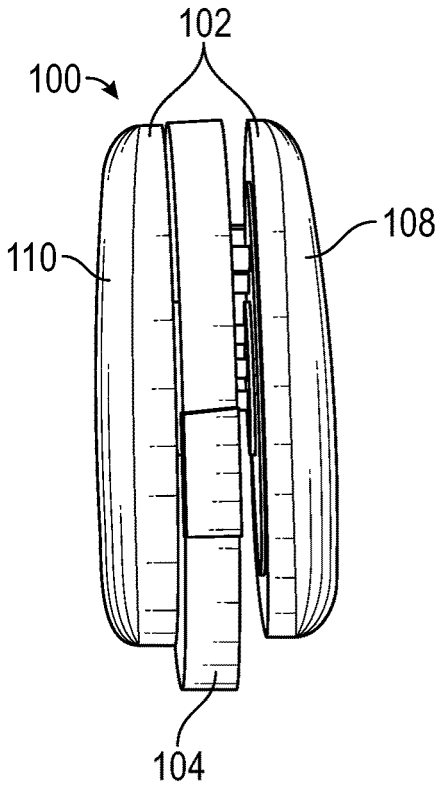
FIG. 5 depicts a front view of the knife, depicting the blade of the knife in the storage position.
Figure 6:
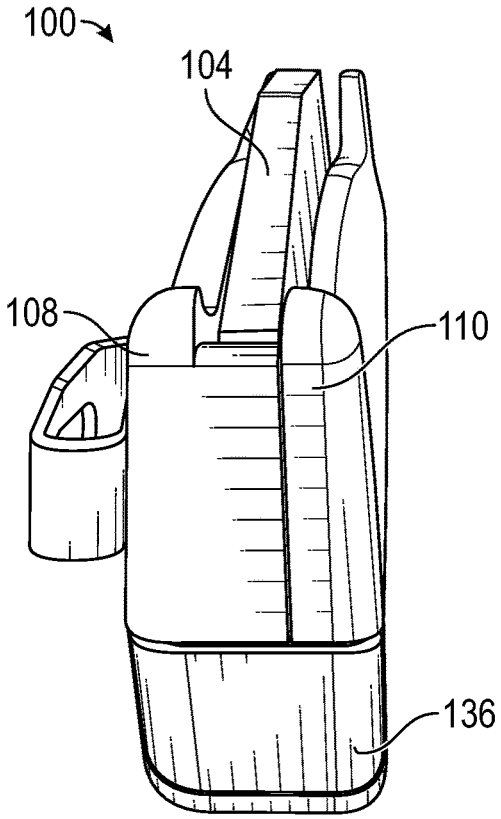
FIG. 6 depicts a perspective view of the knife, depicting the blade of the knife in the storage position.

FIGS. 1-28 depict a folding knife 100 and its components, according to one embodiment. The knife 100 comprises two main components: a handle 102 and a blade 104. The blade 104 is pivotably coupled to the handle 102 such that it can pivot about an axis 106 (FIG. 18) between an open or use position and a closed or storage position. FIGS. 1-2 depict side views of the knife 100 with the blade 104 in the open position. FIGS. 3-4 depict side views of the knife 100 with the blade 104 in the closed position. FIG. 5 depicts a front view of the knife 100 with the blade 104 in the closed position. FIG. 6 is a rear view of the knife 100 with the blade 104 in the closed position.

The knife 100 can be easily disassembled by separating the handle 102 into a first side portion 108 and a second side portion 100 and removing the blade 104. FIGS. 7-13 depict an exemplary method of disassembly. Additional details about the knife 100, its components, and how it can be easily disassembled/assembled without the use of tools are provided below.

Figure 13:
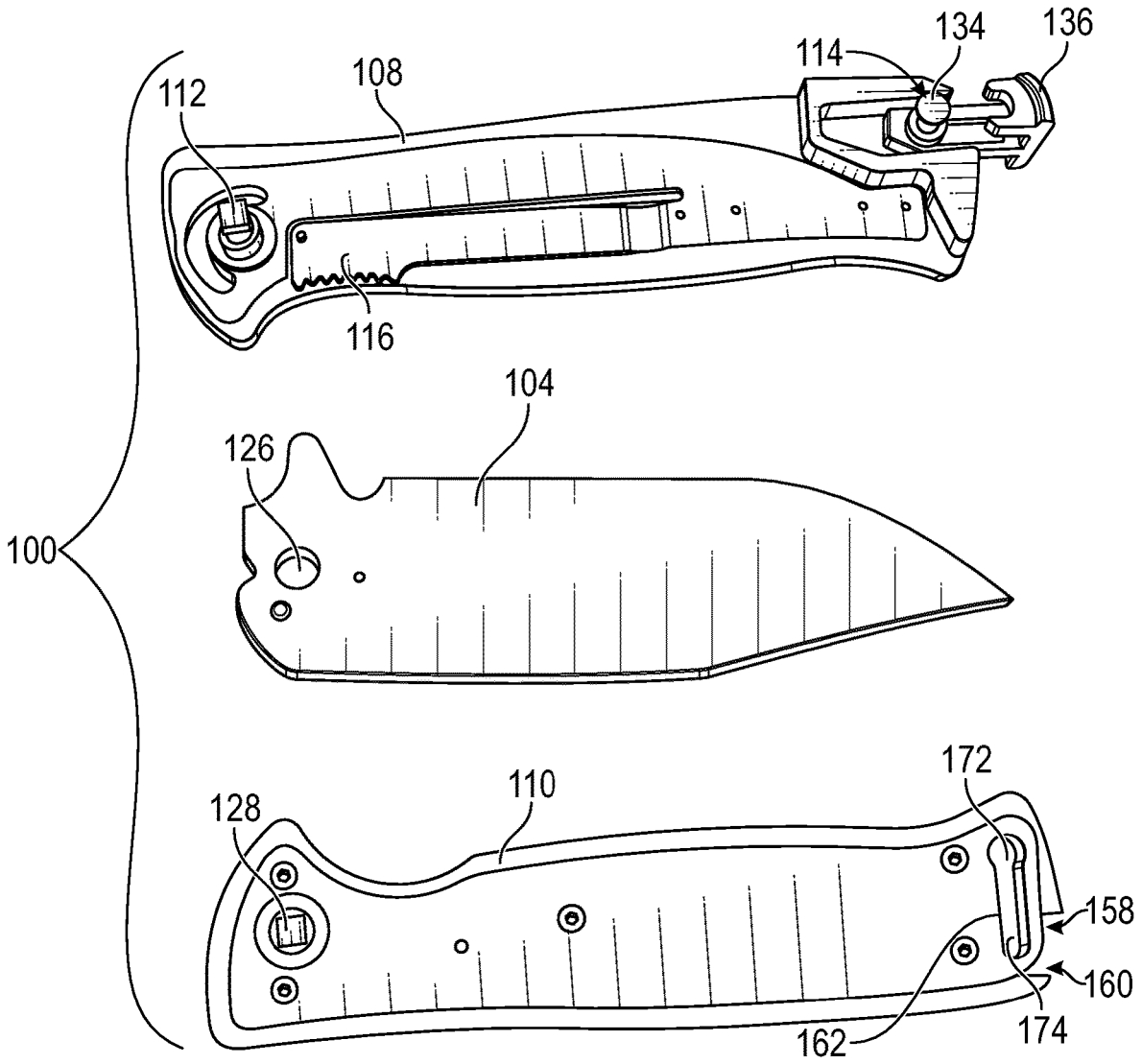
FIG. 13 depicts a side view of the knife in a second partially disassembled state.

Referring now to FIG. 13, the handle 102 of the knife 100 includes a first side portion 108 and a second side portion 110. The first and second side portions of the handle 102 comprise mating and/or locking features that enable the side portions to be selectively coupled together or separated from each other.

The knife 100 further comprises a pivot element 112, a locking mechanism 114, and a blade securing mechanism 116. These components can, for example, be used to releasably couple the first and second side portions of the handle 102 and/or the blade together and/or to secure the blade in the use and/or storage position. The handle 102, the pivot element, and/or the locking element include mating and/or locking features that enable the side portions of the handle to be selectively coupled together or separated from each other.

The pivot element 112 extends laterally from an inner surface of the first side portion 108 and functions as a pivot pin for the blade 104. The pivot element 112 of the first side portion 108 is also configured to engage the second side portion 110 and thereby secure the front end portions of the first and second side portions together. The locking mechanism 114 extends laterally from an inner surface of the first side portion 108 and is configured to engage the second side portion 110 and thereby secure the rear end portions of the first and second side portions together. The locking mechanism 114 can be moved between a locked configuration and an unlocked configuration. With the locking mechanism 114 in the locked configuration (e.g., FIG. 3), the first and second side portions are restricted from pivoting and/or separating laterally relative to each other. With the locking mechanism in the unlocked configuration (e.g., FIG. 7), the first and second side portions can pivot and/or separate from each other, as depicted in FIGS. 10-13. The blade securing mechanism 116 is configured to selectively secure the blade 104 in the use position relative to the handle 102. In the illustrated embodiment, the blade securing mechanism is a liner lock. In other embodiments, various other types of blade securing mechanisms can be used.

Figure 15:
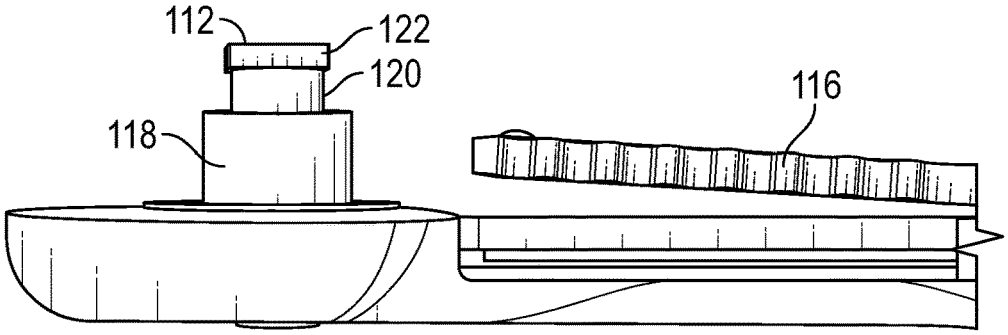
FIG. 15 depicts a detail view of the first side portion of the handle, depicting the front portion of the handle.
Figure 16:
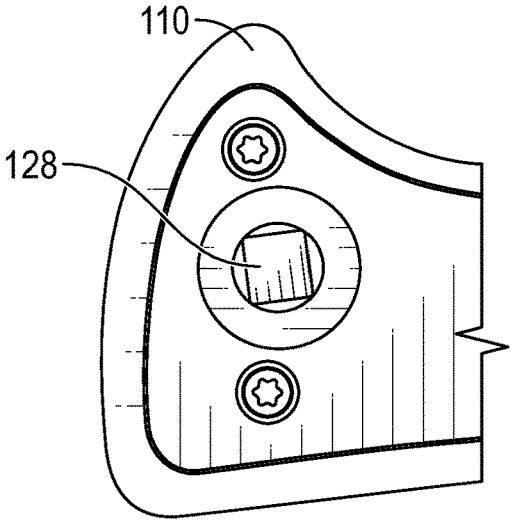
FIG. 16 depicts a detail view of a second side portion of the handle, depicting the front portion of the handle.
Figure 18:
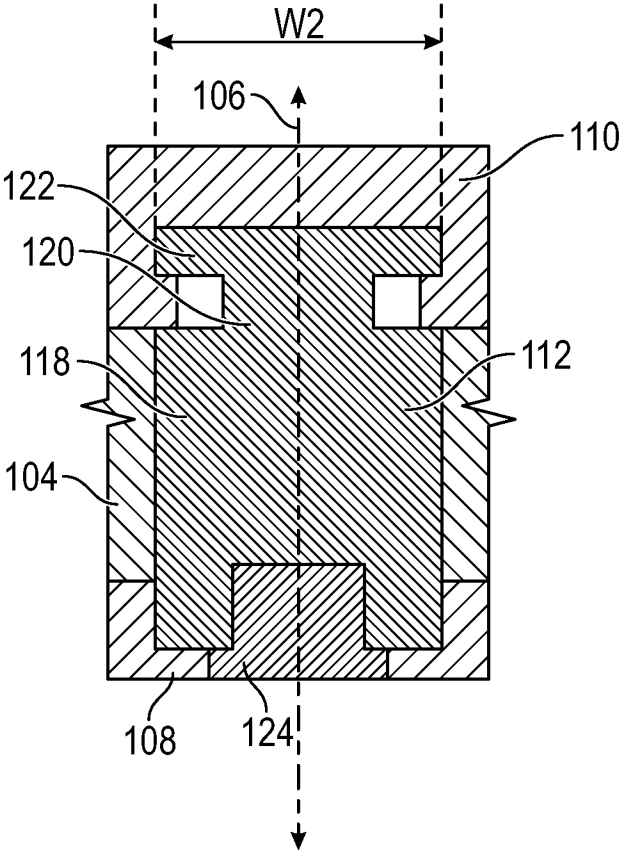
FIG. 18 depicts a cross-sectional view of the knife, taken along the line 18-18 depicted in FIG. 4, and depicting the non-circular head portion of the pivot element rotationally offset with the non-circular opening of the second side portion of the handle.
Figure 17:
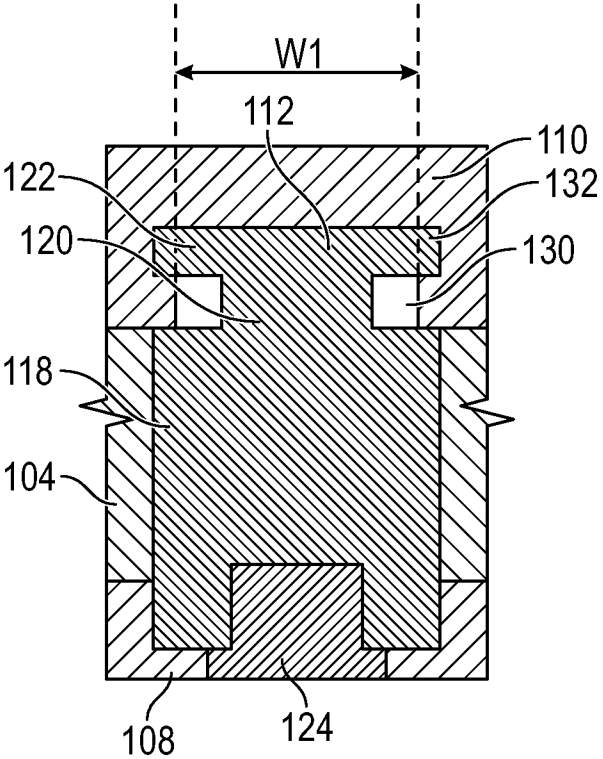
FIG. 17 depicts a cross-sectional view of the knife, taken along the line 17-17 depicted in FIG. 11, and depicting a non-circular head portion of a pivot element rotationally aligned with a non-circular opening of the second side portion of the handle.

Referring to FIG. 15, the pivot element 112 comprises a first cylindrical portion 118 (which can also be referred to as a body portion), a second cylindrical portion 120 (which can also be referred to as a neck portion), and a non-circular portion 122 (which can also be referred to as a head portion). As shown in FIGS. 17-18, the pivot element 112 is removably coupled to the first side portion 108 via a fastener 124. The pivot element can be coupled to the first side portion in additional or alternative ways including adhesive, frictional engagement, and/or integrally forming the pivot element as a single, unitary structure.

Referring again to FIG. 15, the first cylindrical portion 118 of the pivot element 112 extends laterally from the inner surface of the first side portion 108. The first cylindrical portion 118 is configured to extend into and/or through a pivot opening 126 (FIG. 13) of the blade 104, as depicted in FIGS. 17-18. As such, the blade 104 can pivot relative to the handle 102 about the first cylindrical portion 118 from the open configuration to the closed configuration.

As depicted in FIG. 15, the second cylindrical portion 120 of the pivot element 112 extends laterally from the first cylindrical portion 118. The diameter of the second cylindrical portion 120 is smaller than the diameter of the first cylindrical portion 118. The second cylindrical portion 120 is configured such that it can extend into and rotate relative to a non-circular opening 128 (FIG. 16) of the second side portion 110.

Figure 14:
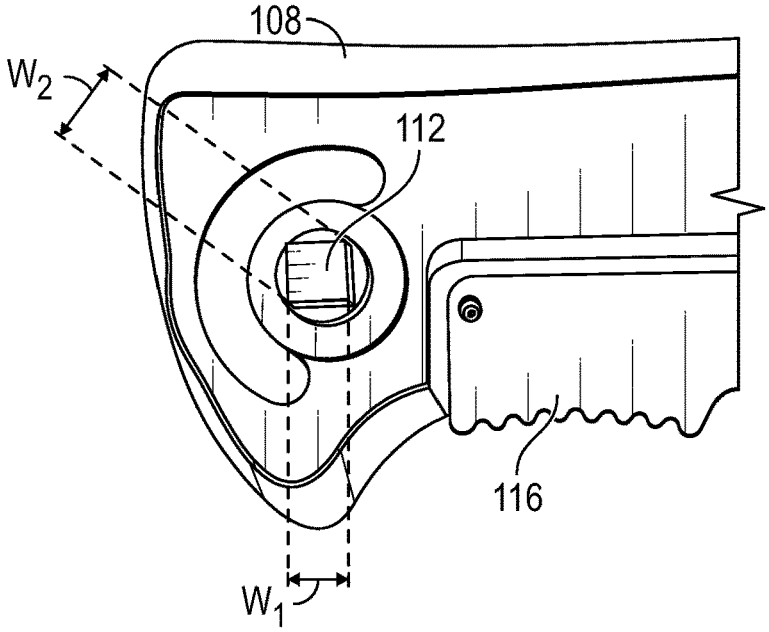
FIG. 14 depicts a detail view of a first side portion of the handle, depicting the front portion of the handle.

The non-circular portion 122 of the pivot element 112 extends laterally from the second cylindrical portion 120. As depicted in FIG. 14, the non-circular portion 122 has a first width $W_1$ and a second width $W_2$. The first width $W_1$ is the narrowest width of the non-circular portion 122 (i.e., the width from a first flat side to a second opposite flat side). The second width $W_2$ is the widest width of the non-circular portion 122 (i.e., the width along from a first corner to a second opposite corner). The first width $W_1$ is smaller than the second width $W_2$, and both the first and second widths are less than the diameter of the first cylindrical portion 118 and the pivot opening 126 of the blade 104. Thus, the non-circular portion 122 can extend through the pivot opening 126 of the blade 104.

As noted above and depicted in FIG. 16, the second side portion 110 of the handle 102 comprises a non-circular opening 128. As depicted in FIG. 17, the non-circular opening 128 includes a first portion 130 and a second portion 132, each comprising a width. The width of the first portion 130 is less than the width of the second portion 132. The width of the first portion 130 of the non-circular opening 128 is slightly greater than the first width $W_1$ of the non-circular portion 122 of the pivot element 112 and is slightly less than the second width $W_2$ of the non-circular portion 122 of the pivot element 112. The width of the second portion 132 of the non-circular opening 128 is slightly greater than the first width $W_1$ and the second width $W_2$ of the non-circular portion 122 of the pivot element 112.

When the non-circular portion 122 of the pivot element 112 is rotationally aligned with the first portion 130 of the non-circular opening 128 of the second side portion 110, the non-circular portion 122 of the pivot element 112 can be inserted through the first portion 130 of the non-circular opening 128 of the second side portion 110 and into second portion 132 of the non-circular opening 128. As used herein, the term "rotationally aligned" means that the non-circular opening 128 of the second side portion 110 is in a rotational position relative to the non-circular portion 122 of the pivot element 112 such that the non-circular portion 122 of the pivot element 112 can fit or slide through the non-circular opening 128 of the second side portion 110 in a direction along the axis 106. FIG. 17 depicts an example of when the non-circular portion 122 and the non-circular opening 128 are rotationally aligned. This configuration can allow the front portions of the handle 102 to be assembled and disassembled by moving the first and second side portions of the handle 102 relative to each other.

When the non-circular portion 122 of the pivot element 112 is rotationally offset with the first portion 130 of the non-circular opening 128 of the second side portion 110, the non-circular portion 122 of the pivot element 112 engages a shoulder of the second side portion 110, which partially defines the second portion 132 of the non-circular opening 128. The term "rotationally offset" as used herein means that the non-circular opening 128 of the second side portion 110 is in a rotational position relative to the non-circular portion 122 of the pivot element 112 such that the non-circular portion 122 of the pivot element 112 cannot fit or slide through the non-circular opening 128 of the second side portion 110 in a direction along the axis 106. FIG. 18 depicts an example of when the non-circular portion 122 and the non-circular opening 128 are rotationally offset. This configuration can secure the front portions of the handle 102 together in an assembled state.

While the illustrated embodiment includes a square head portion and a square opening, various other shapes can be used, including various polygons (e.g., triangle, hexagonal, octagonal), oval, cruciform (cross shaped), etc. In certain embodiments, the non-circular opening shape of the second side portion need not correspond exactly to the non-circular shape of the pivot element. In particular, the opening of the second side portion and the head portion of the pivot element can have any non-circular shape that is sized and shaped to: (1) allow the head portion of the pivot element 112 to slide through the opening when the second side portion 110 is in a first rotational position in which the opening is rotationally aligned with the head portion of the pivot element 112 and (2) restrict the head portion of the pivot element 112 from sliding through the opening when the second side portion is in a second rotational position in which the opening is rotationally offset from the head portion of the pivot element 112.

The locking mechanism 114 is disposed at the rear portion of the handle 102 and is configured to further secure the two side portions of the handle to one another. More specifically, the locking mechanism 114 secures the rear portions of the handle together and can help to ensure that the two side portions do not inadvertently rotate relative to each other from the rotationally offset position to the rotationally aligned position and thereby become unfastened.

Figure 19:
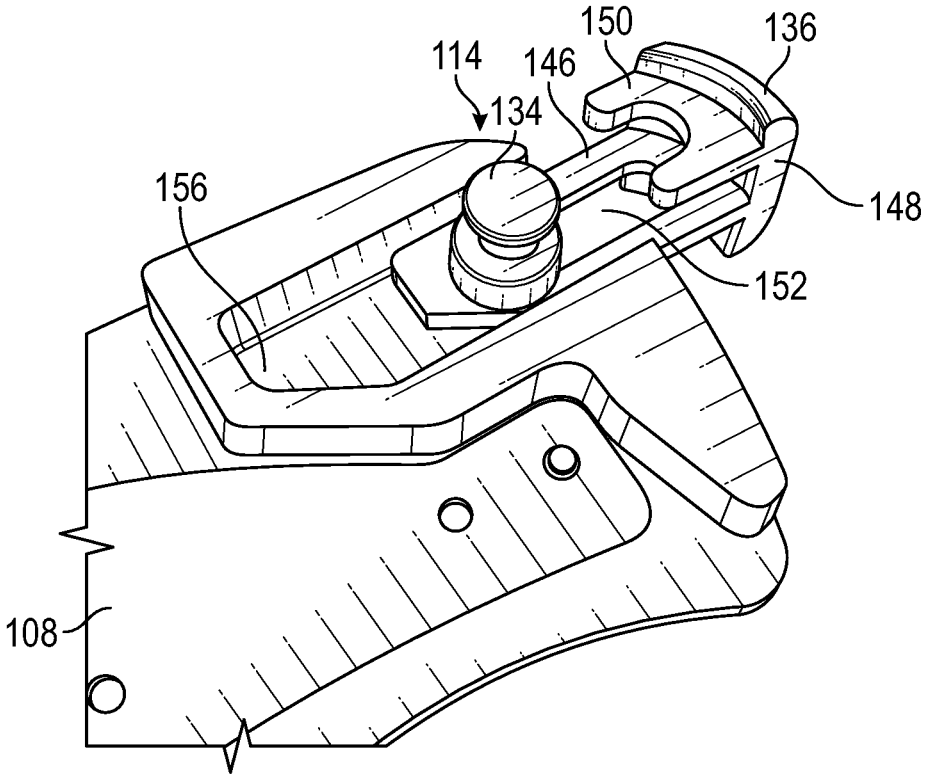
FIG. 19 depicts a detail view of the first side portion of the handle, depicting the back portion of the handle with the locking mechanism in the unlocked position.
Figure 20:
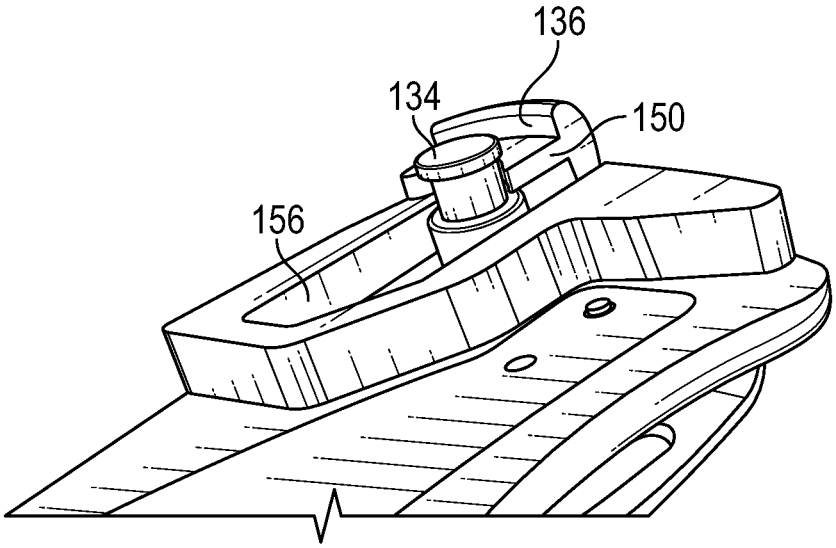
FIG. 20 depicts a detail view of the first side portion of the handle, depicting the back portion of the handle with the locking mechanism in the locked position.

Referring to FIGS. 19-20, the locking mechanism 114 comprises a connecting member 134 and a securing member 136. The connecting member 134 is coupled to and extends laterally from an inner surface of the first side portion 108 of the handle 102. The connecting member 134 is configured to extend into the second side portion 110 of the handle 102. The securing member 136 is movably coupled to the connecting member 134 and the first side portion 108. In particular, the securing member 136 can be moved between a locked state (e.g., FIGS. 3 and 20) and an unlocked state (e.g., FIGS. 7 and 19). In the locked state, the securing member 136 is configured to engage the connecting member 134 and the second side portion 110 of the handle 102 and to restrict relative movement between the connecting member 134 and the second side portion 110 of the handle 102. The engagement between the connecting member 134, the securing member 136, and the second side portion 110 restricts the first and second side portions of the handle 102 from separating. In the unlocked state, the securing member 136 is configured to disengage the connecting member 134 and the second side portion 110 of the handle 102. The disengagement allows the first and second side portions of the handle 102 to move relative to each other. For example, the first and second side portions of the handle 102 can pivot and/or move laterally relative to each other when the securing member 136 is in the unlocked state.

Figure 21:
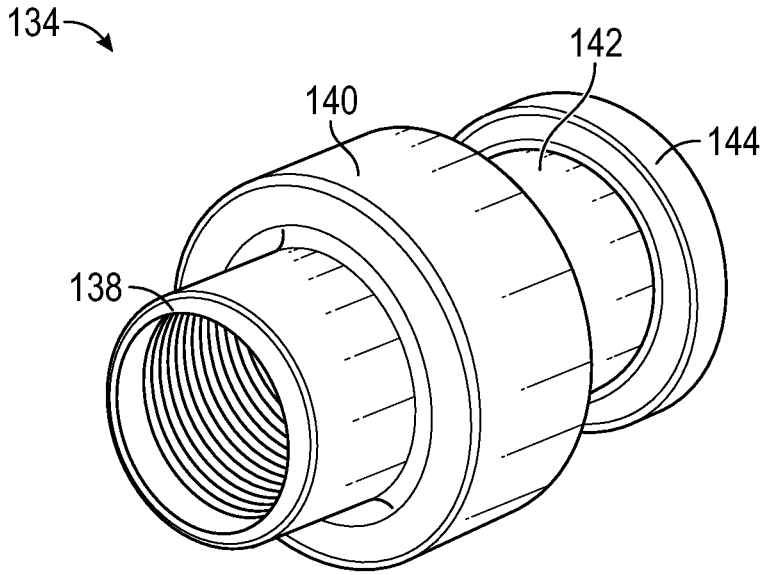
FIGS. 21-22 depict various perspective views of a connecting member of the knife.
Figure 22:
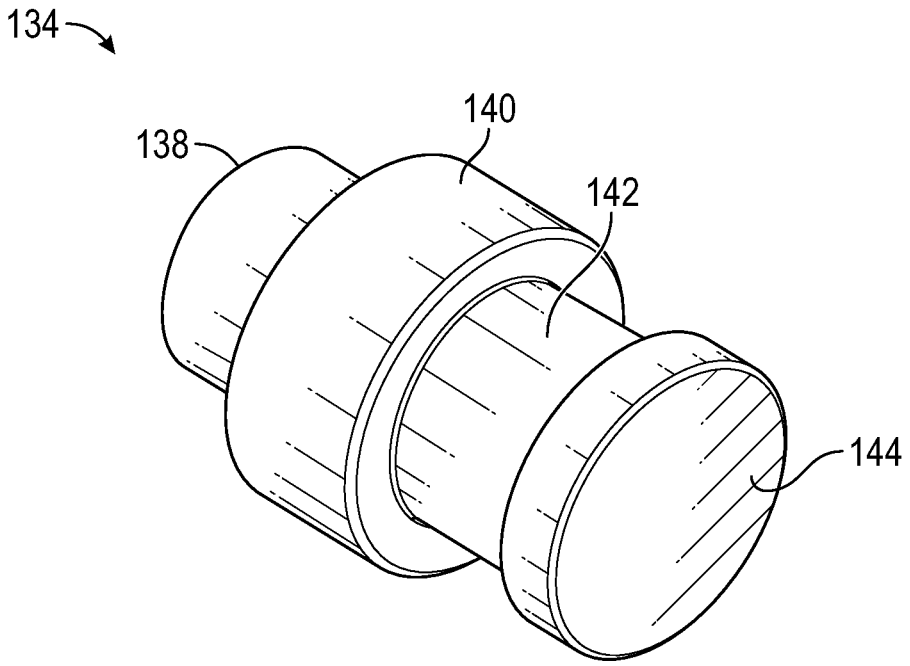

FIGS. 21-22 depict the connecting member 134 of the locking mechanism 114. The connecting member 134 includes a coupling portion 138, a body portion 140, a neck portion 142, and a head portion 144. The body portion 140 has a larger diameter than the coupling portion 138 and the neck portion 142. The head portion 144 has a larger diameter than the neck portion 142. The connecting member 134 can, in some instances, be referred to as a rod or a pin.

Figure 23:
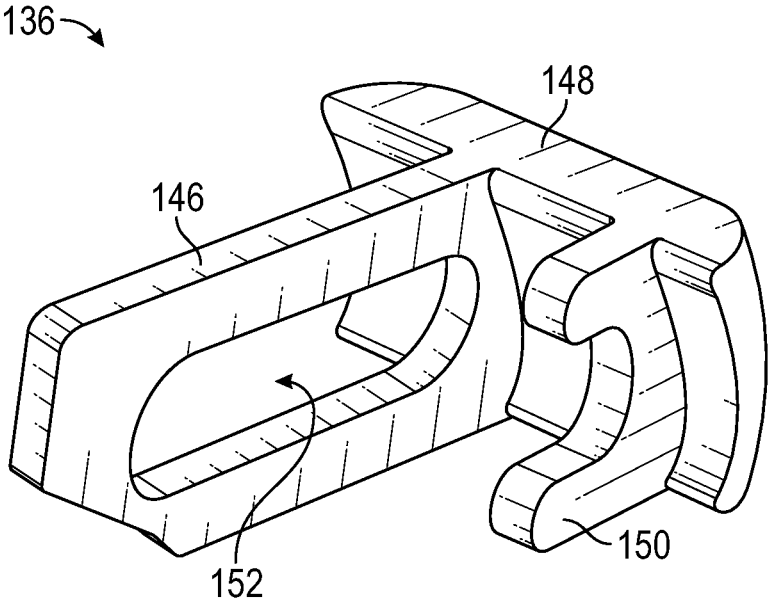
FIGS. 23-24 depict various views of a securing member of the knife.
Figure 24:
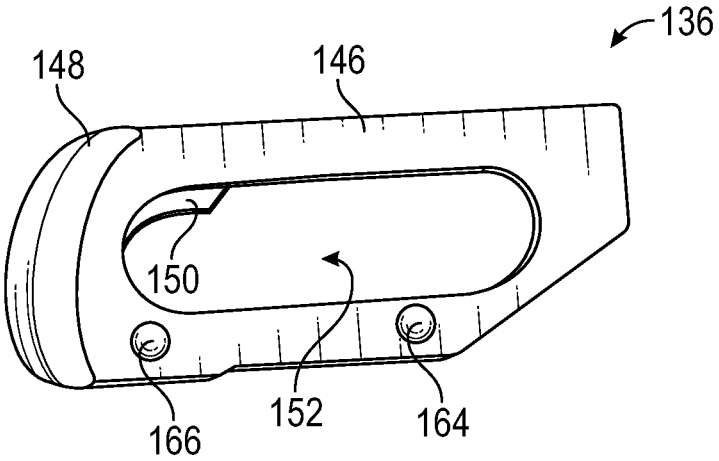

FIGS. 23-24 depict the securing member 136 of the locking mechanism 114. The securing member 136 includes a guide portion 146, a grasping portion 148, and an engagement portion 150. The guide portion 146 comprises a slot 152 and is configured for movably coupling the securing member 136 to the connecting member 134. The grasping portion 148 is configured for moving the connecting member 136 relative to the first and second side portions of the handle 102. The engagement portion 150 can include a collar and/or one or more tabs configured for engaging the second side portion 110 of the handle 102.

Figure 27:
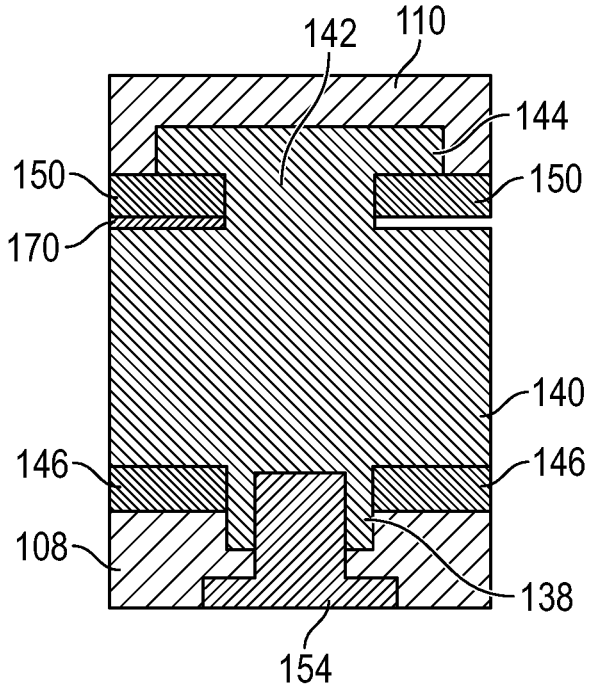
FIG. 27 depicts a cross-sectional view of the knife, taken along the line 27-27 depicted in FIG. 3, depicting the locking mechanism in the locked position.
Figure 28:
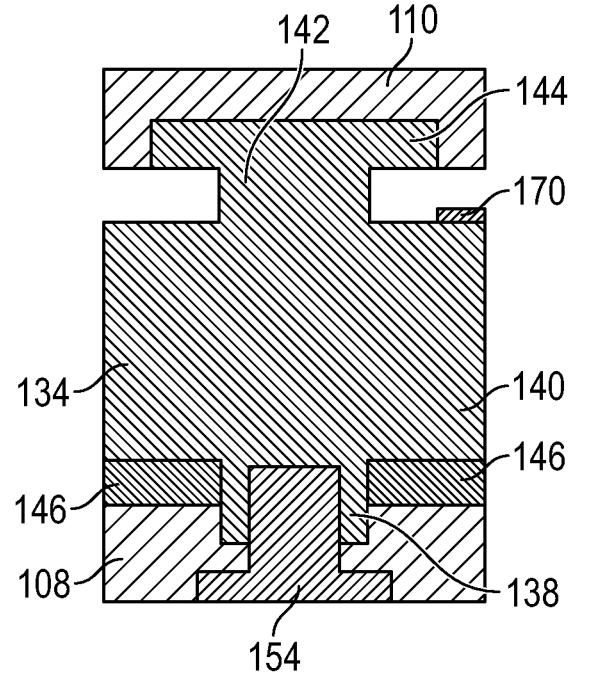
FIG. 28 depicts a cross-sectional view of the knife, taken along the line 28-28 depicted in FIG. 10, depicting the locking mechanism in the locked position and the side portions of the handle in the rotationally offset configuration.

As depicted in FIG. 19, the connecting member 134 can be coupled to the first side portion 108 of the handle 102. For example, the coupling portion 138 can be inserted through the slot 152 of the securing member 136 and can be coupled to the first side portion 108 of the handle 102. This can be accomplished in various manners. For example, as depicted in FIG. 27, the connecting member 136 is coupled to the first side portion 108 of the handle 102 with a fastener 154. Additional and/or alternative means can be used to couple the connecting member 136 to the first side portion 108, including adhesive, welding, and/or frictional fit.

Referring again to FIG. 19, the guide portion 146 of the securing member 136 is disposed between the inner surface of the first side portion 108 and the body portion 140 of the connecting member 134. In this manner, the securing member 136 can move forward and backward relative to the first side portion 108 and the connecting member 134. The forward and backward movement of the securing member 136 is restricted by the ends of the slot 152. The first side portion 108 and the connecting member 134 restrict lateral movement of the securing member 136. In the illustrated embodiment, the first side portion 108 comprises a recess 156 which engages the edges of the guide portion 146 of the securing member 136 and thereby prevents the securing member from rotating relative to the connecting member 134 as the securing member 136 slides forward and backward relative to the first side portion 108 and the connecting member 134. In lieu of forming the recess 156 in the first side portion 108 of the handle 102, in some embodiments, the knife 100 can further comprise a backspacer that includes a notch formed therein configured to act in a manner similar to the recess 156.

The grasping portion 148 of the securing member 136 is configured such that a user can engage the grasping portion 148 with one or more fingers and/or their thumb to move the securing member 136 relative to the handle 102 between the locked and unlocked positions. The grasping portion is also configured to interconnect the first and second side portions of the handle 102 when the securing member 136 is in the locked position. For example, the first and second side portions of the handle 102 comprise a notch 158 (see FIGS. 13 and 25) at their back end portion. When the grasping portion 148 of the securing member 136 is disposed in the notch 158 of the handle 102, the securing member 136 prevents the first and second side portions of the handle 102 from pivoting relative to each other. In some embodiments, the notch 158 and the grasping portion 148 can be configured such that the grasping portion 148 nests and/or is flush with the rear portion of the handle 102 when the securing member 136 is in the locked position (see, e.g., FIGS. 3 and 7).

As depicted in FIG. 27, the engagement portion 150 of the securing member 136 is configured to engage the connecting member 134. More particularly, the engagement portion 150 of the securing member 136 extends into a window 160 (FIG. 26) formed in the rear portion of the handle 102 and engages the neck portion 142 of the connecting member 134. In this manner, the securing member 136 restricts relative lateral movement between the first and second side portions of the handle 102 because the engagement portion 150 of the securing member 136 prevents the head portion 144 of the connecting member 134 from retracting from a groove 162 (FIG. 13) formed in the inner surface of the second side portion 110 of the handle 102. Stated another way, the engagement portion 150 of the securing member 136 secures the head portion 144 of the connecting member 134 against the second side portion 110 of the handle 102. When the securing member 136 is in the unlocked position, the engagement portion 150 of the securing member 136 disengages the head portion 144 of the connecting member 134, which allows the first and second side portions of the handle 102 to move laterally and/or pivot relative to each other.

The engagement portion of the securing member can comprise various shapes and/or configurations. For example, in some embodiments, the engagement portion can comprise tabs or ears that engage the connecting member. In some embodiments, the engagement portion can comprise a C-shape so as to circumscribe 40-60% of the outer circumferential surface of the connecting member 134.

Figure 25:
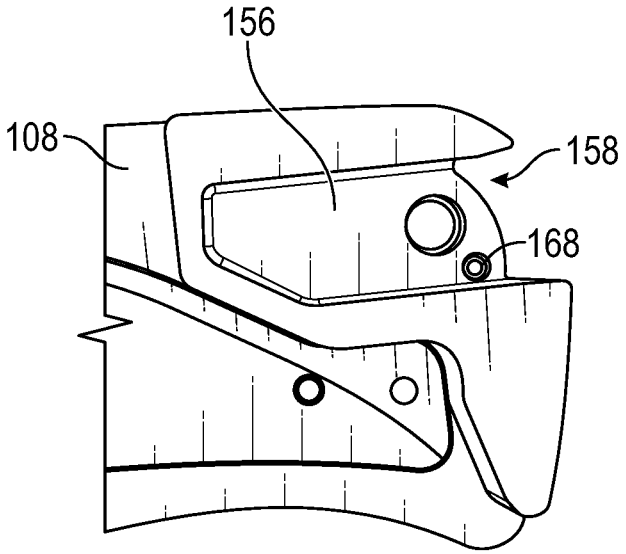
FIG. 25 depicts a detail view of the first side portion of the handle, depicting the back portion of the handle with the locking mechanism removed.

In some embodiments, the locking mechanism 114 can comprise one or more biasing elements configured to bias the securing member to the locked and/or unlocked positions. This can, for example, reduce the likelihood that the securing member 136 will be inadvertently moved (e.g., when the knife is in the user's hand and/or pocket). For example, as depicted in FIGS. 24 and 25, the guide portion 146 of the securing member 136 can comprise one or more detents (e.g., a first detent 164 and a second detent 166), and the first side portion 108 of the handle 102 can comprise a bore 168. A biasing element (e.g., a compression spring) can be disposed in the bore and a ball can be disposed between the biasing element and the guide portion 146 of the securing member 136. The first detent 164 of the securing member 136 can be configured to correspond to the locked position of the securing member 136, and the second detent 166 of the securing member 136 can be configured to correspond to the unlocked position of the securing member 136. When the ball is aligned with one of the detents, the biasing element urges the ball into the detent. The engagement between the ball and the detent provides some resistance to prevent the securing member 136 from moving relative to the first side portion 108 of the handle 102. To move the securing member 136 between the locked and unlocked positions, the force of the biasing member can be overcome by a force exerted on the securing member 136 by the user. This causes the biasing element to compress and the ball to move out of the detent as the securing member 136 is moved between the locked and unlocked positions.

In lieu of or in addition to the detent and ball, the securing member 136 can be biased and/or selectively retained in the unlocked and/or locked positions in various other ways. For example, the interior of the guide portion 146 defining the slot 152 can comprise "snap-fit" type features configured to engage the connecting member 134. Additionally or alternatively, the engagement portion 150 of the securing member 136 can comprise "snap-fit" type features configured to engage the connecting member 134 when the securing member 134 is in the locked position. In such embodiments, the engagement portion 150 of the securing member 136 can be configured similar to a C-clip, an E-clip, and/or a hair-pin clip.

Referring again to FIG. 13, the second side portion 110 of the handle 102 comprises the non-circular opening 128, the notch 158, the window 160, and the groove 162. The non-circular opening 128 is disposed at the front portion of the second side portion 110, and the notch and the groove 162 are disposed at the back portion of the second side portion 110. The non-circular opening 128 is configured to receive the non-circular portion 122 of the pivot element 112. The notch 158 is configured to receive the grasping portion 148 of the securing member 136.

Figure 26:
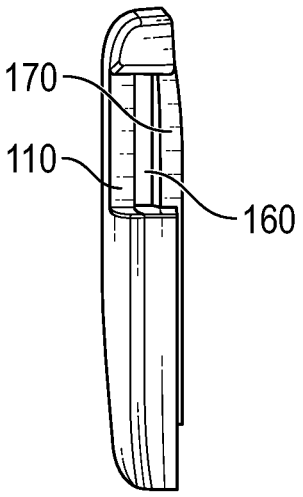
FIG. 26 depicts an end view of the back portion of the second side of the handle.

Referring to FIGS. 13 and 26, the window 160 of the second side portion 110 extends from the notch 158 into the groove 162 and is configured for receiving the engagement portion 150 of the securing member 136. In the illustrated embodiment, the window 160 is formed between the second side portion 110 of the handle 102 and a liner plate 170 that is coupled thereto. Configuring the second side portion 110 with the liner plate 170 can be advantageous, for example, when the handle is formed of a lightweight and/or less resilient material (e.g., composite, aluminum, polymeric, etc.). In such instances, the liner plate 170 can be formed of a harder and/or more resilient material (e.g., steel, titanium, etc.) that is better suited for contacting the pivot element 112 and/or the connecting member 134. This can, for example, prevent or reduce the likelihood that the non-circular opening 128, the window 160, and/or the groove 162 will encounter significant wear (e.g., "wallowing") as the knife is assembled, disassembled, and/or used. This can help keep the knife tight and/or secure as opposed to loose and/or sloppy. In other embodiments, the liner plate 170 can be omitted.

Referring to FIG. 13, the groove 162 formed in the second side portion 110 can comprise an insertion region 172 and a track region 174. The insertion region 172 of the groove 162 is configured such that the neck portion 142 and the head portion 144 of the connecting member 134 can be inserted therein. The track region 174 of the groove 162 has a smaller width that the insertion region 172 and is configured to allow the neck portion 142 to slide therethrough. In this manner, the track region 174 forms a lip configured to engage the head portion 144 of the connecting member 134 and prevent it from withdrawing from the groove 162, except when the head portion 144 of the connecting member 134 is aligned with the insertion region.

The groove 162 can comprise an arcuate shape. This can, for example, allow the connecting member 134 to slide through the groove 162 as the first and second side portions of the handle 102 are pivoted relative to each other. The groove 162 is configured so that the non-circular opening 128 of the second side portion 110 and the non-circular portion 122 of the pivot element 112 are rotationally aligned when the connecting member 134 is disposed in the insertion region 172 of the groove 162. The groove 162 is also configured so that the non-circular opening 128 of the second side portion 110 and the non-circular portion 122 of the pivot element 112 are rotationally offset when the connecting member 134 is disposed in the track region 174 of the groove 162.

Figure 7:
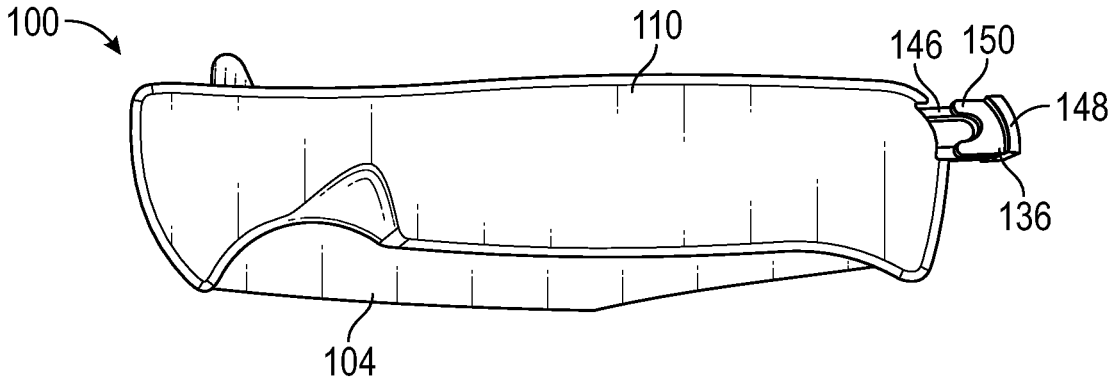
FIG. 7 depicts a side view of the knife, depicting the first side of the knife, the locking mechanism in an unlocked position, and side portions of a handle of the knife in a rotationally aligned configuration.
Figure 8:
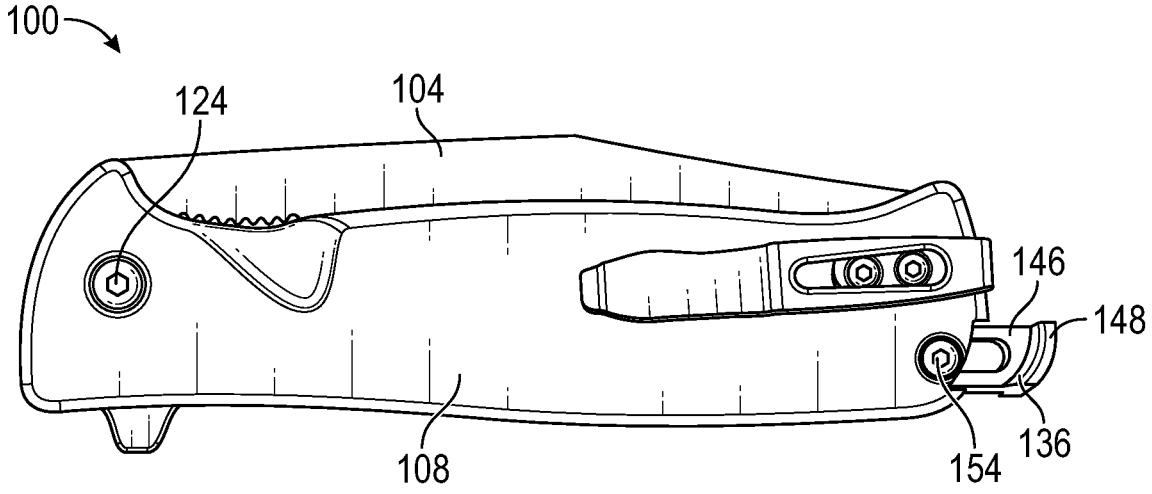
FIG. 8 depicts a side view of the knife, depicting the second side of the knife, the locking mechanism in the unlocked position, and the side portions of the handle in the rotationally aligned configuration.
Figure 9:
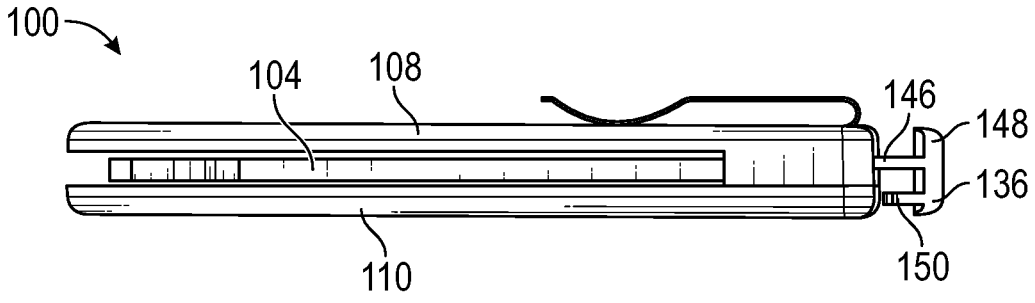
FIG. 9 depicts a top view of the knife, depicting the locking mechanism in the unlocked position and side portions of the handle in the rotationally aligned configuration.

FIGS. 7-13 depict an exemplary method of disassembling the knife 100. As an initial matter, it should be noted that the knife 100 can be assembled and/or disassembled with the blade in the open position or the closed position. As depicted in FIGS. 7-9, the securing member 136 can be moved from the locked position (see, e.g., FIGS. 1-6) to the unlocked position. To do this, a user can hold the grasping portion 148 of the securing member 136 and withdraw it such that it protrudes from the back end portion of the handle 102.

Figure 10:
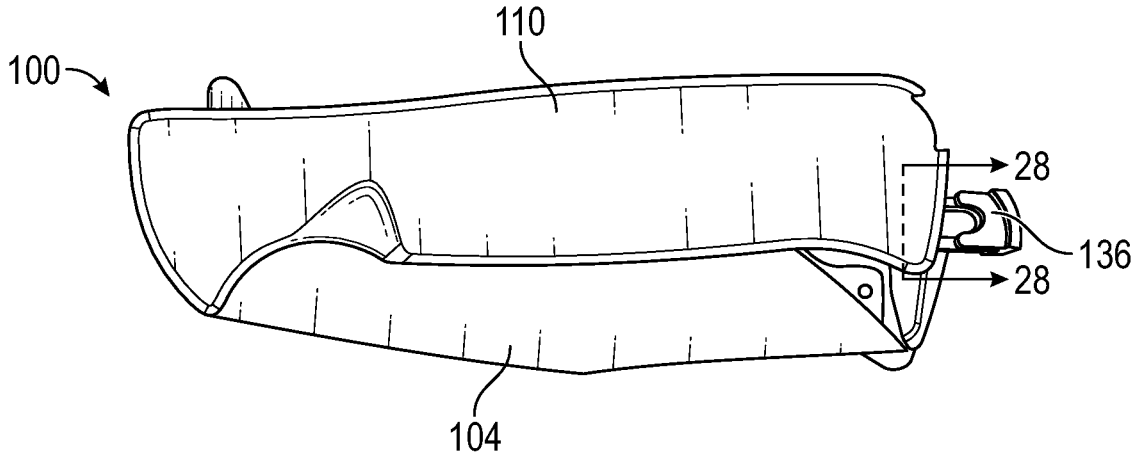
FIG. 10 depicts a side view of the knife, depicting the first side of the knife, the locking mechanism in the unlocked position, and the side portions of the handle in a rotationally offset configuration.
Figure 11:
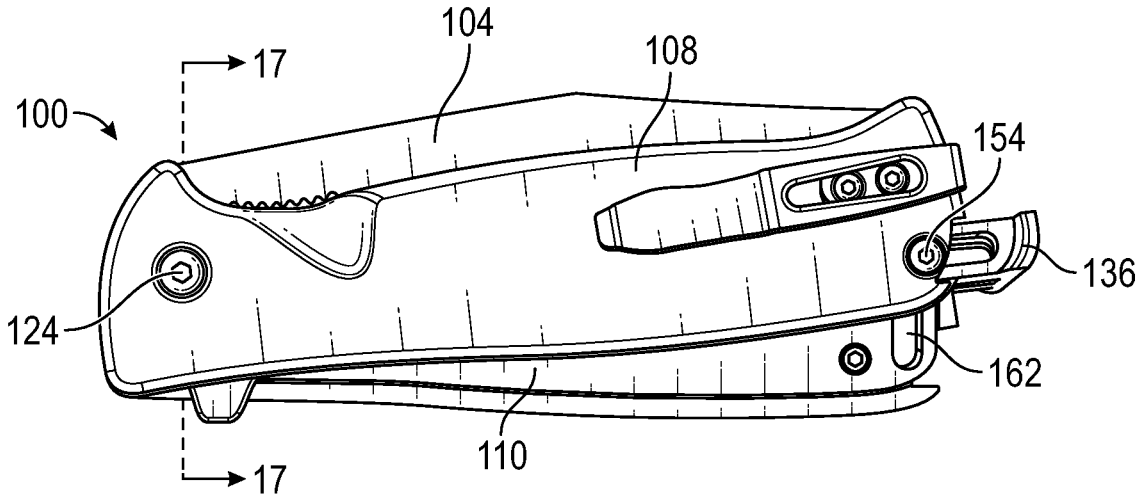
FIG. 11 depicts a side view of the knife, depicting the second side of the knife, the locking mechanism in the unlocked position, and the side portions of the handle in the rotationally offset configuration.
Figure 12:
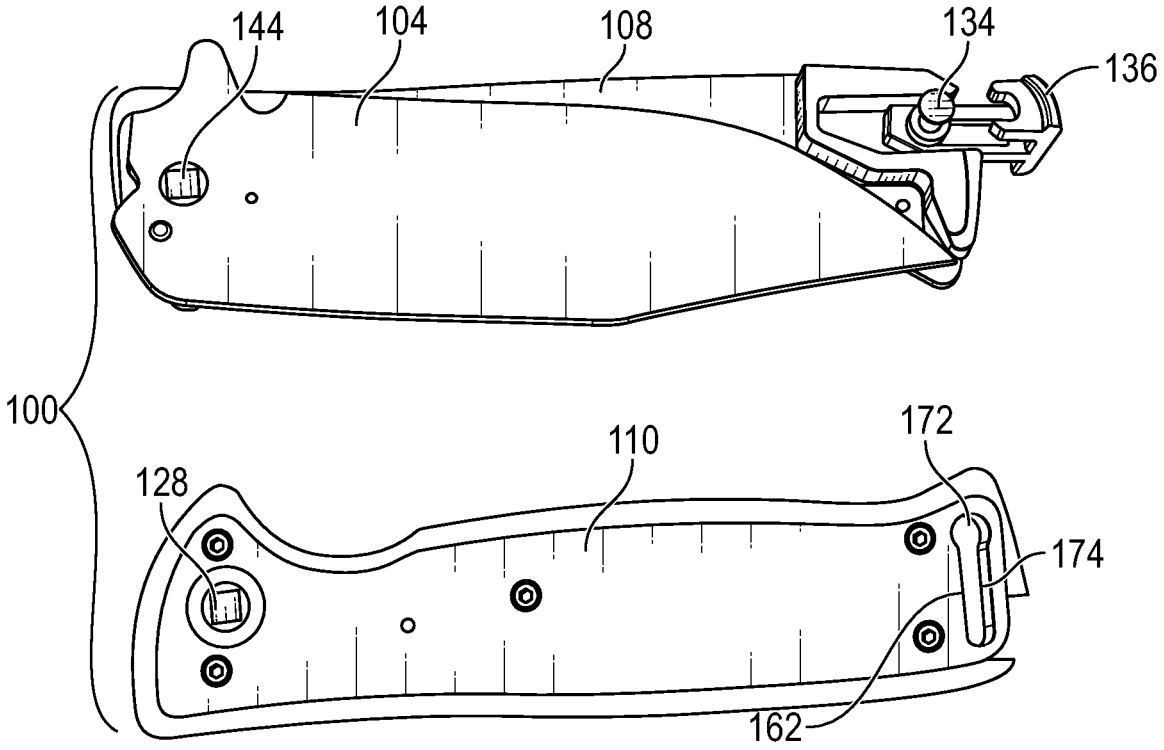
FIG. 12 depicts a side view of the knife in a first partially disassembled state.

With the securing member 136 in the unlocked position, the first and second side portions of the handle 102 can pivot relative to each other about the pivot element 112 at the front portion of the knife 100. As the first and second side portions of the handle 102 pivot relative to each other, the connecting member 134 slides from an end of the track region of the groove 162 towards the insertion region 172 of the groove 162. FIGS. 10-11 depict the first and second side portions of the handle 102 pivoted such that the connecting member 134 of the first side portion 108 is aligned with the insertion region 172 of the groove 162. When the back end portion of the knife 100 is in this position, the non-circular opening 128 of the second side portion 110 and the non-circular portion 122 of the pivot element 112 are rotationally aligned. Accordingly, the first and second side portions of the handle 102 can be separated from each other, as depicted in FIG. 12. With the side portions of the handle 102 separated, the blade 104 can also be separated from the handle 102, as depicted in FIG. 13.

The knife 100 can be assembled, for example, by reversing the disassembly process.

As depicted and described, the knife 100 can be easily disassembly and assembled without the use of tools.

In lieu of or in additional to a blade, one or more other folding tool components can be used (e.g., a screwdriver, a hex key, and/or other component typically found on a folding tool (e.g., a multitool). Such a configuration can be referred to as "a folding tool."

The structural features described herein, with regard to any example, can be used separately and/or combined with other structural features described in any one or more of the other examples.

In view of the many possible embodiments to which the principles of the disclosure may be applied, it should be recognized that the illustrated embodiments are only examples and should not be taken as limiting the scope of the claims. Rather, the scope of the claimed subject matter is defined by the following claims and their equivalents.

The invention claimed is:

1. A folding knife comprising:

a handle including a first side portion and a second side portion, wherein the second side portion of the handle includes a non-circular opening formed in a first end portion and a groove formed in a second end portion;

a blade including an opening, wherein the blade is disposed between the first side portion and the second side portion of the handle;

a pivot element including a cylindrical portion and a non-circular portion, wherein the pivot element is fixedly coupled to the first side portion of the handle, wherein the cylindrical portion extends through the opening of the blade such that the blade can pivot about the cylindrical portion from a storage position to a use position, and wherein the non-circular portion is configured to mate with the non-circular opening of the second side portion; and a locking mechanism comprising a connecting member and a securing member, wherein the connecting member is fixedly coupled to the first side portion and includes a head portion configured to extend into the groove of the second side portion, wherein the securing member is coupled to the connecting member and is movable between a locked position and an unlocked position, wherein in the locked position, the securing member engages the connecting member, retains the head portion of the connecting member within the groove of the second side portion, and retains the first side portion and the second side portion in a rotationally aligned configuration, and wherein in the unlocked position, the securing member disengages the connecting member, allows the first side portion and the second side portion to rotate relative to each other from the rotationally aligned configuration to a rotationally offset configuration, and allows the head portion of the connecting member to withdraw from the groove of the second side portion, wherein when the first side portion and the second side portion are in the rotationally aligned configuration, the non-circular opening of the second side portion is rotationally offset from the non-circular portion of the pivot element, thereby preventing the first side portion from separating from the second side portion, and wherein when the first side portion and the second side portion are in the rotationally offset configuration, the non-circular opening of the second side portion is rotationally aligned from the non-circular portion of the pivot element, thereby allowing the first side portion to be separated from the second side portion.

2. The folding knife of claim 1, wherein the groove comprises an insertion region and a track region, wherein the insertion region comprises a first width that is greater than or equal to a second width of the head portion of the connecting member, and wherein the track region comprises a third width that is less than the second width of the head portion of the connecting member.

3. The folding knife of claim 2, wherein the head portion of the connecting member is disposed in the track region of the groove when the first side portion and the second side portion are in the rotationally aligned configuration, and wherein the head portion of the connecting member is disposed in the insertion region of the groove when the first side portion and the second side portion are in the rotationally offset configuration.

4. The folding knife of claim 1, wherein the securing member comprises a guide portion with a slot, wherein the connecting member extends through the slot, wherein the securing member is slidable relative to the connecting member from a first end of the slot to a second end of the slot, wherein the first end of the slot corresponds to the locked position, and wherein the second end of the slot corresponds to the unlocked position.

5. The folding knife of claim 1, wherein a rear portion of the second side portion comprises a window through which the securing member extends when the securing member is in the locked position.

6. The folding knife of claim 1, wherein the groove in the second side portion of the handle comprises an arcuate shape.

7. A folding knife comprising:

a handle including a first side portion and a second side portion, wherein the second side portion of the handle includes a non-circular opening formed in a first end portion and a groove formed in a second end portion;

a blade including an opening, wherein the blade is disposed between the first side portion and the second side portion of the handle;

a pivot pin including a cylindrical portion and a non-circular portion, wherein the pivot pin is fixedly coupled to the first side portion of the handle, wherein the cylindrical portion extends through the opening of the blade such that the blade can pivot about the cylindrical portion from a storage position to a use position, and wherein the non-circular portion is configured to mate with the non-circular opening of the second side portion; and a locking mechanism comprising a connecting pin and a sliding member, wherein the connecting pin is fixedly coupled to the first side portion and includes a head portion configured to extend into the groove of the second side portion, wherein the sliding member is coupled to the connecting pin and is slidable between a locked position and an unlocked position, wherein in the locked position, a collar of the sliding member engages the connecting pin, retains the head portion of the connecting pin within the groove of the second side portion, and retains the first side portion and the second side portion in a rotationally aligned configuration, and wherein in the unlocked position, the sliding member disengages the connecting pin, allows the first side portion and the second side portion to rotate relative to each other from the rotationally aligned configuration to a rotationally offset configuration, and allows the head portion of the connecting pin to withdraw from the groove of the second side portion, wherein when the first side portion and the second side portion are in the rotationally aligned configuration, the non-circular opening of the second side portion is rotationally offset from the non-circular portion of the pivot pin, thereby preventing the first side portion from separating from the second side portion, and wherein when the first side portion and the second side portion are in the rotationally offset configuration, the non-circular opening of the second side portion is rotationally aligned from the non-circular portion of the pivot pin, thereby allowing the first side portion to be separated from the second side portion.

8. The folding knife of claim 7, wherein the groove comprises an insertion region and a track region, wherein the insertion region comprises a first width that is greater than or equal to a second width of the head portion of the connecting pin, and wherein the track region comprises a third width that is less than the second width of the head portion of the connecting pin.

9. The folding knife of claim 8, wherein the head portion of the connecting pin is disposed in the track region of the groove when the first side portion and the second side portion are in the rotationally aligned configuration, and wherein the head portion of the connecting pin is disposed in the insertion region of the groove when the first side portion and the second side portion are in the rotationally offset configuration.

10. The folding knife of claim 7, wherein the sliding member further comprises a guide portion with a slot, wherein the connecting pin extends through the slot, wherein the sliding member is slidable relative to the connecting pin from a first end of the slot to a second end of the slot, wherein the first end of the slot corresponds to the locked position, and wherein the second end of the slot corresponds to the unlocked position.

11. The folding knife of claim 7, wherein a rear portion of the second side portion comprises a window through which the sliding member extends when the sliding member is in the locked position.

12. The folding knife of claim 7, wherein the groove in the second side portion of the handle comprises an arcuate shape.

13. A folding knife comprising:

a handle including a first side portion and a second side portion, wherein the second side portion of the handle includes a first opening formed in a first end portion and a groove and a notch formed in a second end portion;

a blade including a second opening, wherein the blade is disposed between the first side portion and the second side portion of the handle;

a first pin fixedly coupled to a first end portion of the first side portion and extending through the second opening of the blade into the first opening of the second side portion;

a second pin including a body portion, a neck portion, and a head portion, wherein the second pin is fixedly coupled to a second end portion of the first side portion, and wherein the head portion is configured to extend into the groove of the second side portion; and a securing member slidably coupled to the first side portion of the handle and movable between a locked position and an unlocked position, wherein the securing member comprises a guide portion, a grasping portion, and an engagement portion, wherein the guide portion is disposed between the body portion of the second pin and the first side portion of the handle when the securing member is in the locked position and in the unlocked position, wherein the grasping portion is disposed in the notch of the second side portion when the securing member is in the locked position and withdrawn from the notch of the second side portion when the securing member is in the unlocked position, wherein the engagement portion extends into the groove of the second side portion and engages with the neck portion of the second pin when the securing member is in the locked position and is withdrawn from the groove of the second side portion and disengaged from the neck portion of the second pin when the securing member is in the unlocked position, wherein when the securing member is in the locked position, the first side portion and the second side portion are secured together in a rotationally aligned configuration with the blade disposed between the first side portion and the second side portion, and wherein when the securing member is in the unlocked position, the first side portion and the second side portion are pivotable relative to each other about the first pin to a rotationally offset configuration in which the first side portion, the second side portion, and the blade can be separated from each other.

14. The folding knife of claim 13, wherein the second pin further comprises a connection portion disposed between the body portion and the first side portion of the handle, wherein the connection portion comprises a smaller diameter than the body portion.

15. The folding knife of claim 14, wherein the guide portion of the securing member comprises a slot configured to receive the connection portion of the second pin.

16. The folding knife of claim 15, wherein the connection portion of the second pin is disposed at a first end of the slot when the securing member is in the locked position, and wherein the connection portion of the second pin is disposed at a second end of the slot when the securing member is in the unlocked position.

17. The folding knife of claim 14, wherein the connection portion of the second pin is coupled to the first side portion of the handle with a fastener.

18. The folding knife of claim 13, wherein the second side portion of the handle comprises a liner plate, and wherein the groove is formed in the liner plate.

19. The folding knife of claim 13, wherein the groove comprises an insertion region and a track region, wherein the insertion region of the groove comprises a first width that is equal or greater to a second width of the head portion of the second pin, and wherein the track region of the groove comprises a third width that is less than the second width of the head portion of the second pin.

20. The folding knife of claim 13, wherein the first pin comprises a head portion having a non-circular shape taken in a plane perpendicular to a longitudinal axis of the first pin, and wherein the first opening in the second side portion of the handle comprises the non-circular shape such that the head portion of the first pin can be inserted therein.

* * * * *